US005429415A

United States Patent [19]

Meade

[11] Patent Number: 5,429,415

[45] Date of Patent: Jul. 4, 1995

[54] CONVERTIBLE FURNITURE FRAME WITH AUTOMATICALLY-OPERATED SUPPORT LEGS

[76] Inventor: Thomas L. Meade, 274 Reese Rd., Nittany Mountain Industrial Park, State College, Pa. 16801

[21] Appl. No.: 23,641

[22] Filed: Feb. 26, 1993

[51] Int. Cl.[6] ..... A47C 17/16

[52] U.S. Cl. ..... 297/354.13; 297/377; 297/118; 5/38

[58] Field of Search ..... 297/118, 19, 21, 22, 297/63, 64, 354.13, 377; 5/37.1, 38

[56] References Cited

U.S. PATENT DOCUMENTS

| | | | |
|---|---|---|---|
| 1,017,488 | 2/1912 | Zimdars | 297/64 |
| 1,087,497 | 2/1914 | Killman | 297/118 |
| 2,200,193 | 5/1940 | Taylor | 297/22 |
| 2,244,470 | 6/1941 | Neunherz | 5/38 |
| 2,294,475 | 9/1942 | McAllister . | |
| 2,480,773 | 8/1949 | Ross | 297/19 |
| 2,622,659 | 12/1952 | Stelmack | 297/64 |
| 2,700,164 | 1/1955 | Abajian | 5/38 |
| 2,751,605 | 6/1956 | Sogge | 5/38 |
| 2,754,888 | 7/1956 | LaPalme | 297/354.13 |
| 2,954,567 | 10/1960 | Abajian | 5/38 |
| 4,538,308 | 9/1985 | Grigoriev . | |
| 4,642,823 | 2/1987 | Wiggins . | |
| 4,692,952 | 9/1987 | Dougher et al. . | |
| 4,829,611 | 5/1989 | Fireman et al. . | |
| 4,875,244 | 10/1989 | Tremblay . | |
| 5,170,519 | 12/1992 | Meade | 5/37.1 |
| 5,315,722 | 5/1994 | Djie | 5/38 X |

FOREIGN PATENT DOCUMENTS

| | | | |
|---|---|---|---|
| 528344 | 5/1954 | Belgium | 297/377 |
| 553040 | 2/1958 | Canada | 297/63 |
| 645489 | 7/1930 | France | 5/38 |
| 710150 | 6/1931 | France | 5/38 |
| 1194975 | 11/1959 | France | 297/118 |
| 1032494 | 6/1958 | Germany | 5/38 |
| 2063063 | 6/1981 | United Kingdom | 297/19 |

*Primary Examiner*—Kenneth J. Dorner
*Assistant Examiner*—David E. Allred
*Attorney, Agent, or Firm*—Caesar, Rivise, Bernstein, Cohen, & Pokotilow, Ltd.

[57] ABSTRACT

A convertible furniture frame construction which is movable from a first orientation to at least a second orientation. The frame includes at least two sections pivotally connected together by hinge members and being movable relative to each other to permit the frame to be moved between the first and second orientations. The two frame sections are held in a first orientation by a locking mechanism which releasably locks the two sections in place. The frame further includes a self-actuating swing arm assembly to act as a support member when the frame is in a second (bed) and third (reclining couch) orientation.

5 Claims, 4 Drawing Sheets

Fig. 3.
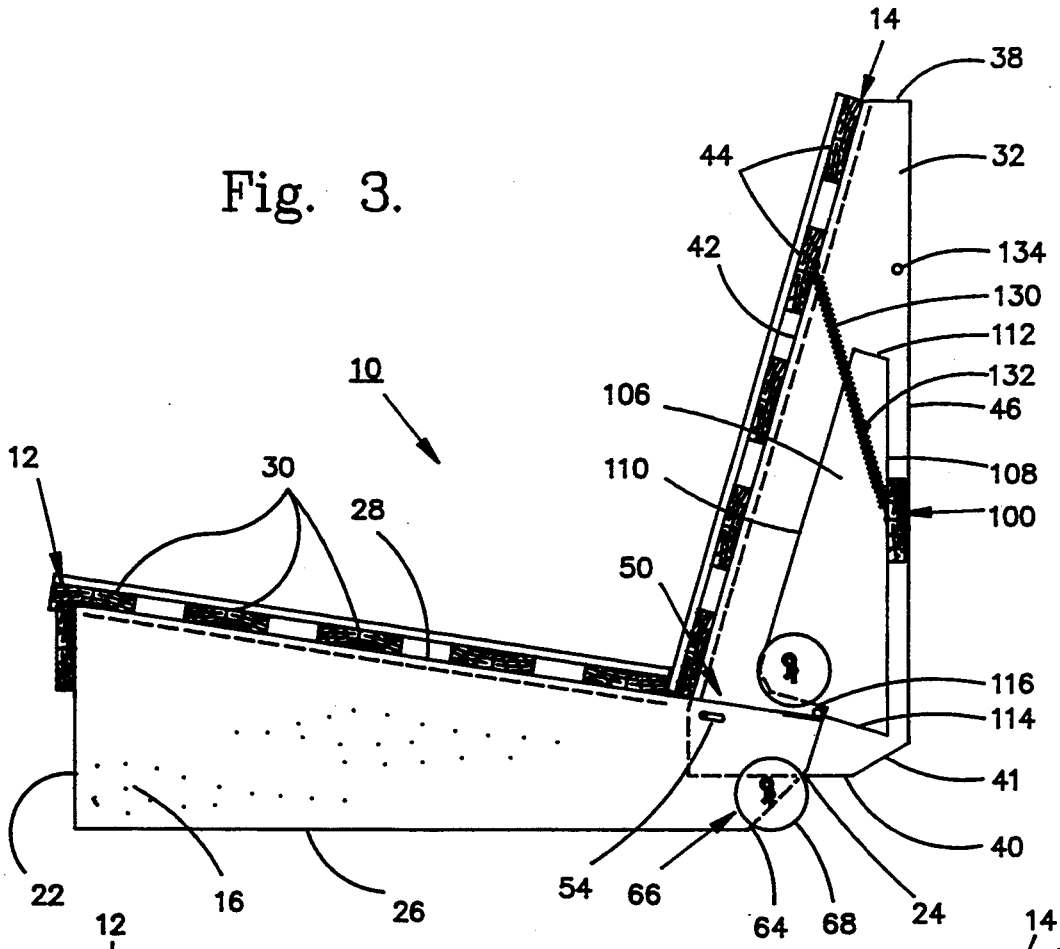
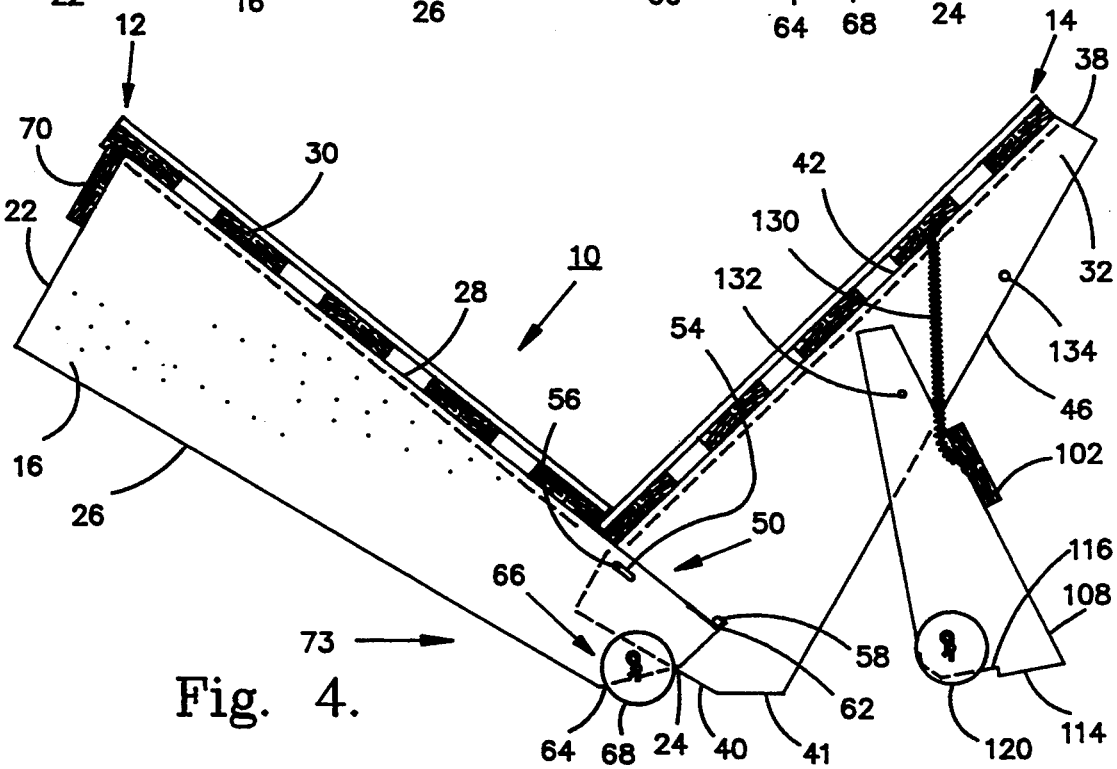
Fig. 4.

CONVERTIBLE FURNITURE FRAME WITH AUTOMATICALLY-OPERATED SUPPORT LEGS

BACKGROUND ART

Bi-fold frames for supporting futons are well known in the prior art. These frames include two sections which generally are movable relative to each other, between a "couch" orientation, in which the sections are disposed to form a seat and backrest, and a "bed" orientation, wherein futon-supporting surfaces of the two sections generally lie in the same plane.

In the bed orientation, the futon functions as a mattress, with the distance between the front edge of the seat section and the rear edge of the backrest section constituting the width of the bed, and with the length of the frame, from one side edge to the other side edge, constituting the length of the bed.

To maintain the sections of the bi-fold units in the couch orientation to provide a seat and backrest for supporting a futon, a locking arrangement may be provided between the pivotal sections. In one such prior art construction, pivoting locking blocks are rotatably secured to transversely-spaced side frame members of the backrest section. These blocks are designed to engage the upper surface of the section forming the seat, to prevent inadvertent movement of the backrest section relative to the seat section when the frame is being employed in its "couch" orientation. Although this pivoting block arrangement may provide a satisfactory locking force to maintain the bi-fold sections in the "couch" orientation, it is quite cumbersome to operate the blocks for the purpose of converting the frame to its "bed" orientation, and then back to its couch orientation. Specifically, in order to make these conversions it is necessary for the person to physically bend over and rotate the block on each side frame of the backrest section. This generally requires the user to move from one side of the frame to the other, and in some cases, may even require two individuals to simultaneously move the pair of pivoting blocks. Moreover, since the pivoting blocks generally are adjacent the lower end of the backrest section (in order to properly engage the seat section) the person operating the frame often needs to bend into an uncomfortable position to operate the pivoting blocks.

In another arrangement, wooden dowel pins are provided to fit into aligned holes of the seat section and backrest section, at each side of the construction, when the seat and backrest sections are disposed in the "couch" orientation. In this orientation, the openings are aligned to receive the dowel pins. To convert this latter frame construction into a bed, a person first removes the dowel pin from one side of the construction, and then from the other side. Moreover, it is quite inconvenient and cumbersome to again try to reposition and lock the frame members in the "couch" orientation.

In my prior U.S. Pat. No. 5,170,519, the entire disclosure of which is incorporated by reference herein, other prior art convertible bi-fold and tri-fold frame constructions are disclosed. In both of these latter constructions, the frame is movable from a first to at least a second orientation. The frame has at least two sections pivotally connected together and movable relative to each other. One of the two sections includes a frame member having one end closely adjacent to, and overlapping an end of a frame member of the other of the two sections. A unique hinge and stop arrangement is provided to permit the relative rotational movement between the two sections to convert the frame between the first and second orientations, and also to lock the two sections against relative rotational movement in one of the first and second orientations. The hinge and stop arrangement includes an elongate slot in one of the overlapping ends and a hinge pin connected to the other of the overlapping ends. The hinge pin is rotatably retained within the slot to provide a pivotal connection between the first and second sections. Cooperating stop members are provided on the adjacent overlapping ends to engage each other when the hinge pin is in a first location within the elongate slot to maintain the frame in the first orientation, and for disengaging from each other when the hinge pin is in a second position within the elongate slot to permit the frame to assume the second orientation.

One fundamental problem of the prior art "L-frames" is that if they have large leg members to provide a bed frame which places the mattress a suitable height above the floor, then there is much wasted space between the rear of the backrest portion of the L-frame when the backrest portion is placed adjacent the wall of a room, since the leg members associated with the backrest portion are typically located at the rear of the backrest portion when not in use. The wasted space behind the L-frame, when the unit is in the couch orientation, is extremely undesirable, especially since L-frame units are typically utilized in small rooms or apartments. Prior art constructions which have attempted to minimize this wasted space by decreasing the width of the leg members also produce an undesirable L-frame. By decreasing the width of the legs, when the L-frame is placed in the bed orientation, the frame and mattress lie too low to the ground, which is not as aesthetically pleasing to many individuals. Additionally, a low bed frame is also undesirable since it is very difficult for many individuals to get into and out of the bed.

In view of the problems associated with prior art frames, a need exits for an economical and simple-to-operate bi-fold unit which can easily be converted between a "couch" and a "bed" frame orientation, without wasting space adjacent the unit, while providing a bed height which is not unacceptably low to the ground, Two prior art convertible furniture constructions utilizing spaced apart swing arms are disclosed in U.S. Pat. Nos. 2,751,605 and 2,700,164. However, these constructions do not provide the advantages and benefits of the construction of the present invention.

Other prior art convertible furniture constructions are also shown in U.S. Pat. Nos. 4,875,244; 4,829,611; 4,692,952; 4,642,823; 4,538,308 and 2,294,475.

However, none of the prior art constructions known to the inventor solve the heretofore mentioned problems associated with frame constructions in the simple and reliable manner accomplished by the present invention.

OBJECTS OF THE INVENTION

It is a general object of this invention to provide a convertible furniture frame which is simple in construction, easy to use and reliable in operation.

It is a further object of this invention to provide a convertible furniture frame which has an uncomplicated mechanism to hold the frames as a seating piece (e.g., a chair, couch or similar construction) in both an upright and lounging position, while permitting the easy and reliable release of the mechanism to permit the frames to assume a different orientation, such as the orientation of a bed frame.

It is a further object of this invention to provide a convertible furniture frame construction which is well suited to support futons in different orientations, and which can be moved between at least some of these different orientations from a single location relative to the frame.

It is still a further object of this invention to provide a convertible, bi-fold frame construction for supporting a futon in different orientations, which is simple in construction, easy to use and reliable in operation.

It is yet another object of this invention to provide a convertible frame which occupies less space than prior art constructions, while providing an acceptable and comfortable bed height.

SUMMARY OF THE INVENTION

The above and other objects of this invention are achieved in a convertible furniture frame construction which is movable from a first orientation to at least a second orientation. The frame includes at least two sections pivotally connected together and being movable relative to each other to permit the frame to be moved between the first and second orientations.

A locking mechanism is provided to permit relative rotational movement between the two sections to permit conversion of the frame between the first and second orientations, and also for locking the two sections against relative rotational movement in the first orientation.

In the preferred embodiment of this invention, the frame further comprises a rotatably retained or pivotal swing arm extending rearwardly from the rear portion of the second frame section which acts as a backrest. The swing arm acts as a support member when the frame is in the second orientation as a bed and in the third orientation as a reclining couch.

In a preferred embodiment, an extension spring connects the rear portion of the backrest section of the frame to the swing arm to aid in the storage and movement of the swing arm. The pivoted swing arm normally is retained by the spring in a stored position when the frame is in a seating piece orientation, and is of a sufficient mass which enables it to automatically move into a second position by partially overcoming the spring retaining force holding the swing arm in the stored position, as the frame is being rotated rearwardly, from the seat section thereof, to convert the frame into the bed orientation, as will be explained in greater detail later in this application. Specifically, the extension spring has a line of action on a first side of the pivot axis when the swing arm is in the stored position and this line of action shifts to the opposite side of the pivot axis when the swing arm is moved by its own mass into a second position away from the rear of the backrest frame section when the seat is lifted.

In the most preferred embodiment of this invention, the two sections of the convertible furniture frame provide a seat section and backrest section in a first orientation, a bed frame in a second orientation and a reclining couch in a third orientation.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 3 is a side view along line 3—3 of FIG. 1 showing the swing arm in the stored position;

FIGS. 4–7 are sectional views similar to FIG. 3, showing sequential stages in changing the orientation of the frame sections from that shown in FIG. 3 in a couch orientation, to that shown in FIG. 7, in a bed orientation.

DESCRIPTION OF THE PREFERRED EMBODIMENTS OF THE INVENTION

Figure 1:
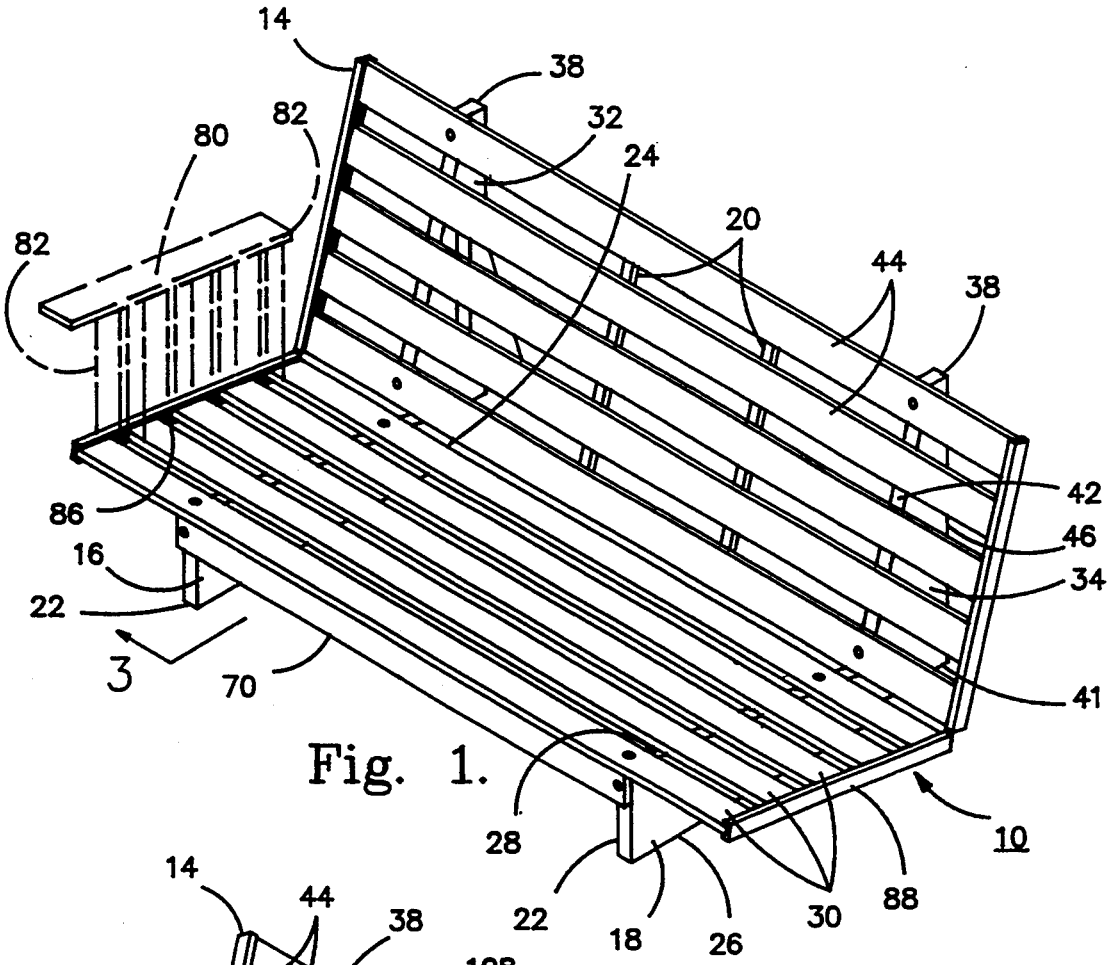
FIG. 1 is an isometric view of a convertible furniture frame with an optional, removable arm rest shown in phantom.

Referring now in greater detail to the various figures of the drawings wherein like reference characters refer to like parts, a convertible furniture frame embodying the present invention is generally shown at 10 in FIG. 1 in the form of a bi-fold futon frame including two sections 12 and 14. The two sections 12 and 14 are rotatably interconnected by a hinge and stop arrangement 50 (FIGS. 3–7) to be described in detail later. As show in FIGS. 3–7, this hinge and stop arrangement 50 positively maintains the two sections 12 and 14 in the orientation of a seating piece, preferably to support a futon thereon. Suffice it to state that at this point, the hinge and stop arrangement 50 is identical to that disclosed in my earlier-identified U.S. Pat. No. 5,170,519.

Figure 2:
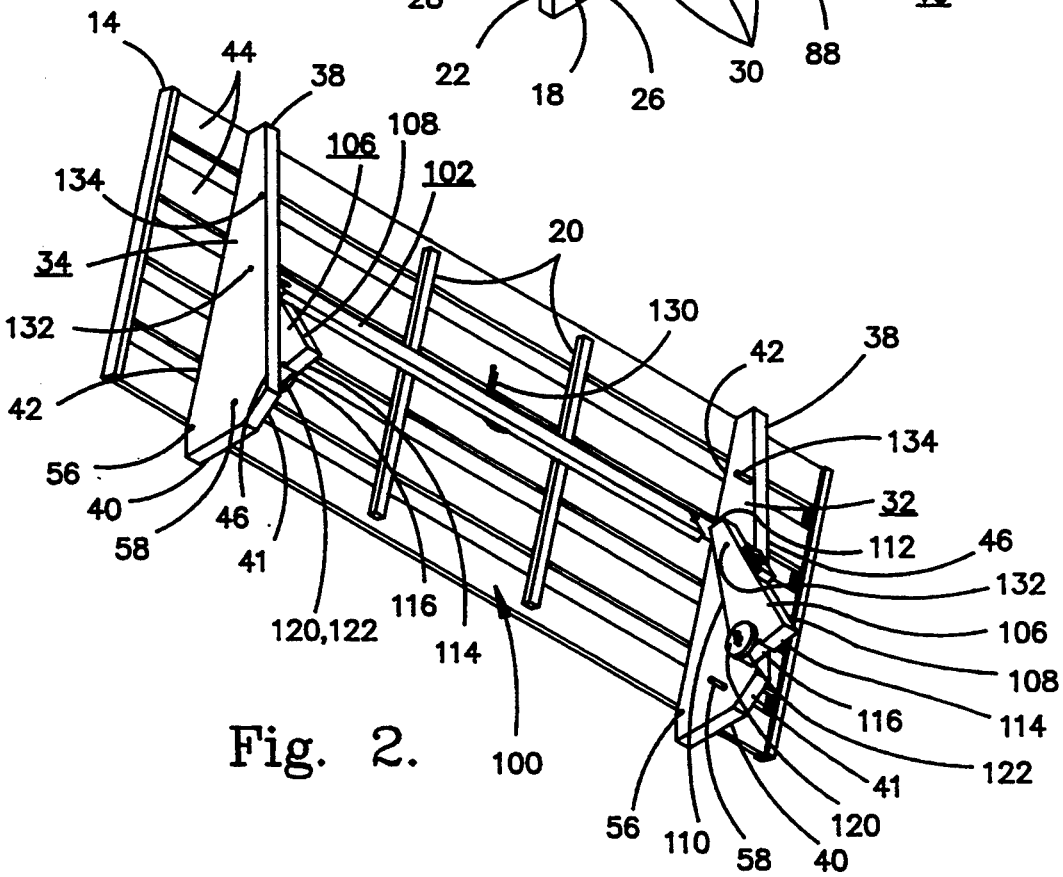
FIG. 2 is a rear isometric view of the back frame member only of the convertible furniture frame, showing a unique swing arm construction in a partially extended position for illustration purposes.
Figure 6:
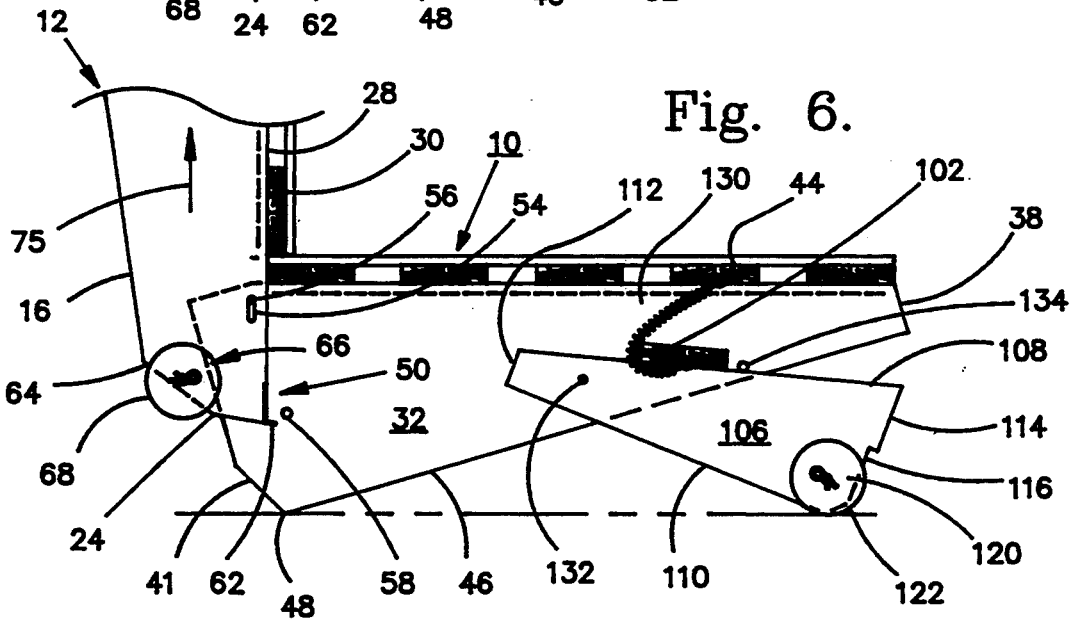
Figure 7:
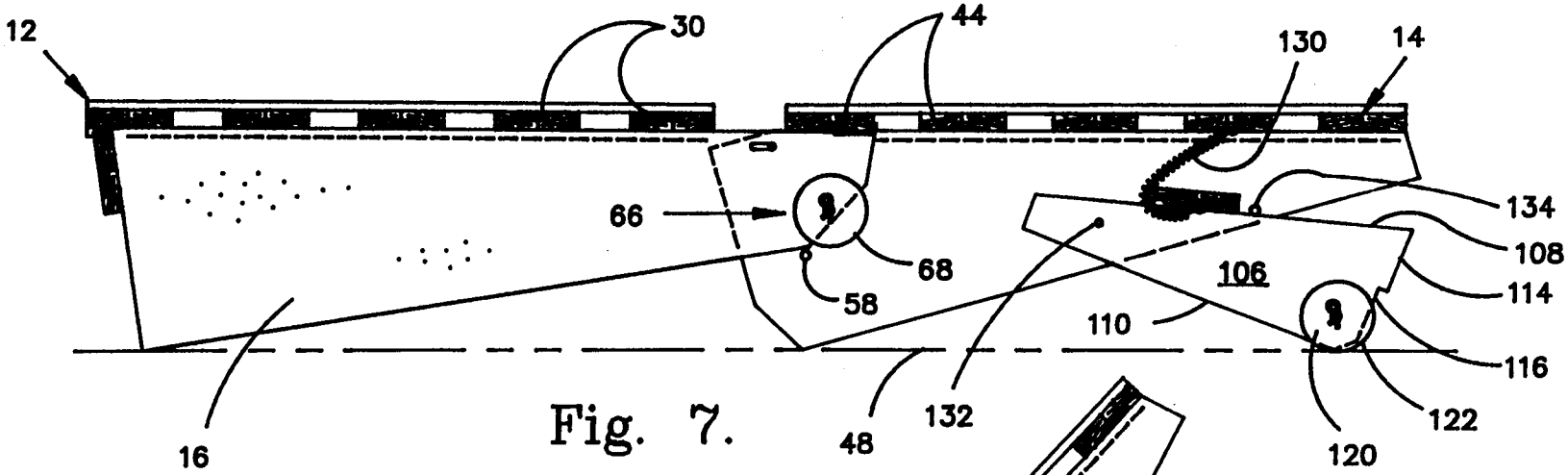
Figure 8:
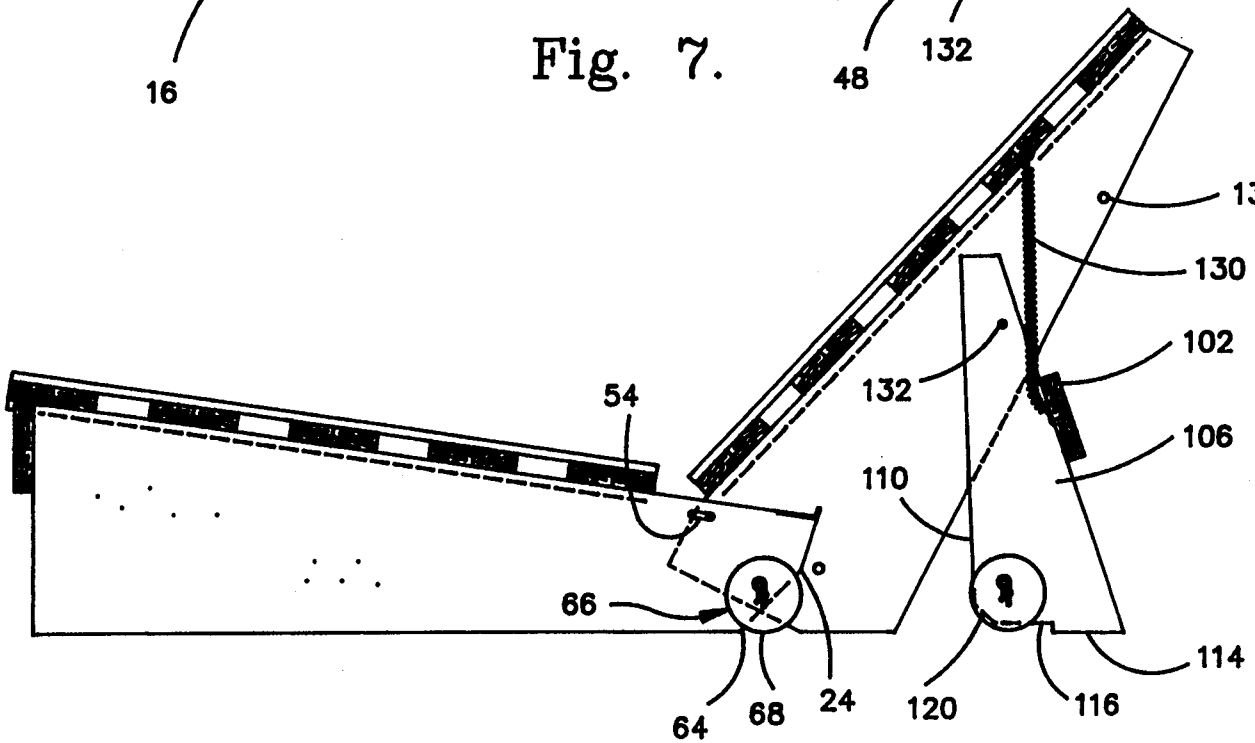
FIG. 8 shows the convertible furniture frame of this invention in an orientation to provide a reclining seating piece.

As shown in FIG. 2, the frame 10 also includes a swing arm assembly 100 to be described in further detail below, which aids in converting the frame to the couch, reclining couch and bed configurations shown in FIGS. 4–8, and provides support to maintain the frame 10 in the bed and reclining couch positions as shown in FIGS. 7 and 8.

Referring specifically to FIGS. 1 and 2, the section 12 includes identical transversely spaced-apart side frame members or legs 16 and 18. Each of these frame members has a forward edge 22, a rear edge 24, a bottom edge 26 (which is supported on the floor or other supporting surface) and a top edge 28 to which a plurality of elongate slats 30 are secured. These slats 30 provide the supporting surface for the futon. Reference to a "floor" in the description and claims herein, is not intended to be limiting, but includes any and all types of flooring, surfaces, platforms, etc., upon which a frame, such as the frame of the present invention, is or can be utilizable.

As shown in FIG. 3, each of the frame members 16 and is tapered in a direction from the forward edge 22 to the rearward edge 24. In the preferred embodiment of this invention each of these frame members is formed from $1\frac{1}{4}''$–$1\frac{1}{2}''$ wide stock, and is tapered linearly at an angle of approximately $8\frac{1}{2}$ degrees from the horizontal.

The section 14 is similar in construction to section 12, and additionally comprises one or more supporting slats 44. In section 14 however, the configuration of transversely spaced-apart side frame members or legs 32 and 34, is somewhat different. Specifically, with section 14 oriented at approximately a 17 degree angle to the right of the vertical axis, as viewed in FIG. 3, to provide a comfortable, sloping backrest section (FIGS. 1-3), the frame members 32 and 34, each have an upper surface 38 which is oriented in a generally horizontal plane, a first bottom surface portion 40, a second inclined bottom surface portion 41, a front surface 42 to which elongate slats 44 are secured by nails, screws or other suitable fastening means, and a rear surface 46. The frame members 32 and 34 are tapered in a direction from bottom surface portions 40 and 41, to upper surface 38, so that the rear surface 46 lies in a generally vertical plane. Because of this orientation, the rear surface 46 of the frame 10 tends to lie closely adjacent a vertical wall against which the frame 10 may be positioned, to minimize wasted space between the frame 10 and an adjacent wall of the room when the frame is in the seating piece orientation.

As described below, the second inclined bottom surface portion 41 is inclined at an angle with respect to bottom surface 40, to engage the floor or other supporting surface, when the frame 10 is oriented into the reclining couch orientation, as is illustrated in FIG. 8.

As shown in FIG. 2, the swing arm 100 comprises a transversely extending elongate member 102 fixedly secured to transversely spaced-apart legs 104 and 106 thereof. The swing arm 100 facilitates converting the frame 10 between the couch and bed orientations (and reclining couch orientation) as will be described in detail below, and also provides support for frame member 14 when the frame 10 is in the bed and reclining couch orientations.

Each of the legs 104 and 106 of the swing arm 100, is pivotally connected to respective frame members 34 and 32 as described in further detail below. Each leg 104 and 106, comprises a rear surface 108, a front surface 110, an upper surface 112, and a bottom surface 114 which rests on the floor when the frame 10 is in the reclining couch position as shown in FIG. 8.

Each leg 104 and 106 may optionally comprise a bottom indent 116, when wheels 120 are secured to each leg 104 and 106 and utilized as part of the swing arm assembly 100, as described in further detail below. The indent 116 permits the securement of the wheels 120 so that the outer circumference 122 of each wheel 120 lies in the same plane as that of the bottom surface 114. The outer circumference 122 of each wheel also lies in the same plane as supporting surface edge 128 of legs 104 and 106, where that edge contacts the floor.

To aid in the functioning of the swing arm assembly 100, a conventional extension spring 130, having loops at each end (not shown) is provided. One loop of the spring 130 is secured to a slat 44 of the frame 14 and the second loop of the spring 130 is secured to the elongate member 102 of the swing arm assembly 100, by a screw, fastener or any other suitable means.

In the preferred embodiment, the swing arm 100 is attached at approximately its longitudinal midpoint by the extension spring 130 to the rear portion of the backrest section 14 of the frame 10 to aid in the retaining and movement of the swing arm 100. The pivoted swing arm 100 is of a weight or mass which enables it to partially overcome the retaining force holding the swing arm in the stored position, and thereby move or pivot away from the backrest section 14, when the frame is being converted from the couch orientation of FIG. 1, to the bed orientation of FIG. 7, i.e., is automatic or self-actuating, as described herein. The extension spring 130 has a line of action on a first side (i.e., inside or forwardly of a pivot line or axis, located between pivot 132 and front surface 42, when the swing arm 100 is in the stored position as shown in FIG. 3. This imposes a force on the swing arm in a direction to maintain the swing arm in a stored condition. The line of action of the extension spring 130 is on the opposite side (outside or rearwardly) of the pivot line or axis, between pivot 132 and stop pin 134, as shown in FIG. 4, when the swing arm 100 is moved into a second position away from the rear of the backrest frame section. As will be explained in detail below, movement into the second position occurs automatically, due to the weight or mass of the swing arm, when the frame is being converted from the seating piece orientation to the bed orientation.

Referring to FIGS. 3-7, a locking mechanism, such as a hinge and stop arrangement 50 is provided to positively maintain or lock the sections 12 or 14 at approximately a 98½ degree angle relative to each other (with the angle being tilted approximately 8½ degrees clockwise from the horizontal plane, as viewed in FIG. 3) to form a seating piece frame (e.g., loveseat, couch or chair) as is shown in FIG. 1, and which can easily be manipulated to permit relative movement between the sections 12 and 14 to form a bed frame, as is shown in FIG. 7.

Referring to FIGS. 3-7, the cooperative elements of the hinge and stop mechanism 50 associated with adjacent side frame members 16 and 32 of sections 12 and 14, respectively, will described. It should be understood that this same hinge and stop mechanism is associated with the adjacent side frame members 18 and 34.

Referring specifically to FIGS. 3 and 6, the hinge and stop mechanism 50 includes an elongate slot 54 provided in side frame member 16 of section 12, and into which a hinge pin 56 extends. This hinge pin 56 is secured within an opening (not shown) in the side frame member 32 of section 14, and cooperates with the slot 54 to provide a hinge connection about which the sections 12 and 14 are rotatable relative to each other.

Referring to FIGS. 3 and 6, the slot 54 is elongated, having its long dimension aligned in a direction from forward edge 22 to the back edge 24 of side frame member 16, and being essentially parallel to the top surface 28 of the side frame member. When the sections 12 and 14 are maintained in orientation of a seating piece, as is shown in FIGS. 1 and 3, the hinge pin 56 extends into the elongate slot 54 adjacent the left or forward end of the slot, as viewed in FIGS. 3 and 6.

As will be explained in greater detail hereinafter the provision of an elongate slot 54 for cooperating with the hinge pin 56, permits the desired locking of the sections 12 and 14 in the orientation illustrated in FIGS. 1 and 3, while at the same time permitting easy release of the locking arrangement, to permit the sections 12 and 14 to assume the configuration shown in FIGS. 7 and 8, in which the frame 10 functions as a bed frame (FIG. 7) or as a reclining couch (FIG. 8) for a futon or other type mattress.

Referring to FIGS. 3-7, the locking arrangement provided by the hinge and stop mechanism 50, includes a stop pin 58 retained within an opening (not shown) in side frame member 32 of the section 14, and extending transversely therefrom into overlying relationship with an upper section of a metal stop plate 62. The metal stop plate 62 is secured to the rear edge 24 of frame member 16 by screws, adhesive, or other suitable fastening means. In addition to engaging the stop plate 62, the stop pin 58 also engages an angled section of the top surface 28 of the side frame 16. In fact, the stop pin is located so that its predominant force is imposed against the top surface 28 of the side frame 16, as opposed to being imposed upon the stop plate 62, when a force is applied to backrest 14, such as when an individual is seated on a futon supported over the frame.

In the most preferred embodiment of this invention the frame members 32 and 34 are made of a hard wood, to minimize the likelihood of wear in the region of the openings in which the stop pins 58 are secured.

It should be understood that the cooperative arrangement between the elongate slot 54 and the hinge pin 56, as well as the cooperative arrangement between the stop pin 58 and stop plate 62, as described above, also are provided between the adjacent sections of side frame member 18 of section 12 and side frame member 34 of section 14. Since the construction of the hinge and stop mechanism 50 is identical to this other location, no further description is necessary to provide a teaching that is understandable to a person skilled in the art.

Referring to FIGS. 3–6, the back edge 24 of the side frame 16 has a tapered, or inclined, lower edge section 64, and a wheel or roller 66 is rotatably secured to the frame member 16 adjacent this latter edge. The wheel 66 is mounted so that a portion of the peripheral surface 68 of the wheel is located beyond the edge 64, and therefore capable of rotatably engaging the floor or other frame-supporting surface, as the frame is being converted from its orientation as a seating piece (e.g., FIGS. 1 and 3) into its orientation as a bed (FIG. 7) or as the frame is converted from the reclining seating piece orientation shown in FIG. 8, to the bed orientation shown in FIG. 7, as described below.

It should be understood that the back edge 24 of the other side frame member 18 is likewise provided with a inclined edge surface identical to edge surface 64, and that a rotatable roller or wheel, identical to wheel 66, is secured to the other side frame member 18 in exactly the same location as the wheel 66 is secured to the side frame member 16.

Referring to FIGS. 3–7, the manner in which the convertible furniture frame 10 is converted from a seating piece orientation, as is shown in FIGS. 1 and 3, to a bed frame orientation as is shown in FIG. 7, will now be described.

First, and foremost, it should understood that the entire conversion operation can be carried out by a person standing adjacent the front edge of section 12. In other words, there is no need for the individual to manually engage any locking mechanisms adjacent the opposed side frames of the frame construction or to manually engage the swing arm assembly, in order to release the locking engagement between the sections 12 and 14 and the swing arm assembly required to convert the frame between seating piece and bed orientations.

To convert the frame from a seating piece to a bed an individual stands adjacent the front of the seating piece (i.e., adjacent the front of the section 12) and lifts or rotates the seating piece in an upward direction, to approximately 45 degrees from the horizontal, as is shown in FIG. 4. The user can easily grip the section 12 by engaging transversely extending slat or skirt 70, which is secured by screws or other suitable fastening means to the forward edge 22 of each of the frame sections 16 18 as shown in FIGS. 3 and 4.

As shown in FIG. 4, after the seat section 12 initially has been lifted or rotated, the periphery 68 of the wheel or roller 66 immediately comes into contact with the floor. However, it should be clearly understood that in this orientation, the sections 12 and 14 are retained in a locked condition to prevent the opening or separation of the sections 12 and 14 relative to each other. In addition, the swing arm assembly 100 simultaneously rotates away from the rear of frame member 14 about pivot point 132, due to the gravitational forces exerted on the mass of the swing arm assembly as the seat section 12 is lifted or rotated and is therefore self-actuating or automatic. The spring 130 of the spring arm assembly biases the swing arm outwardly, to prevent spring arm assembly from accidentally returning to its stored position.

With the wheel 66 engaging the floor, the frame 10 can easily be rolled to any desired location, as is schematically indicated by the double-headed arrow 73 in FIG. 4. Once the frame 10 is in its desired location, the seat section 12 can be further rotated upwardly, or clockwise as viewed in FIG. 4. As this rotation occurs, the swing arm assembly 100 will remain biased outwardly from the frame section 14 by spring 130, and the wheel 120 of each of the legs 104 and 106 will eventually engage and roll along the floor.

The extension spring 130 facilitates retaining the swing arm assembly 100 away from the frame section 14 and prevents the swing arm assembly from moving back towards the frame section 14 as movement of the frame occurs when converting the frame from the seating orientation to the bed orientation. An important feature of the preferred embodiment of the present invention is that the pivoted swing arm 100 is of a mass which enables it to partially overcome the retaining force of the spring holding the swing arm in the stored position, to thereby shift the line of action of the spring force from one side of the spring arm pivot to the other side of that pivot.

The extension spring has a line of action on a first side of a pivot line or axis when the swing arm is in the stored position to retain the swing arm assembly in the stored position. The line of action of the extension spring is on the opposite side of the pivot line or axis when the swing arm assembly is moved into a second position away from the rear of the backrest frame section to bias the swing arm assembly in a manner to enable it to engage the floor and act as a support.

It is preferable that wheels 120 be utilized in a frame 10 which is to be utilized on a flooring surface such as carpeting, etc. to provide a smooth transition between configurations. Wheels 120 may not be necessary, however, if the swing arm assembly is to be utilized with a smooth floor surface such as wood or linoleum, which would permit the swing arm assembly to slide thereover with minimal frictional interference, even without wheels. In addition, wheels may be replaced with other types of devices or materials, such as felt, plastic hemispherical furniture floor sliders, etc., to enable the swing arm to facilitate conversion between frame configurations.

Figure 5:
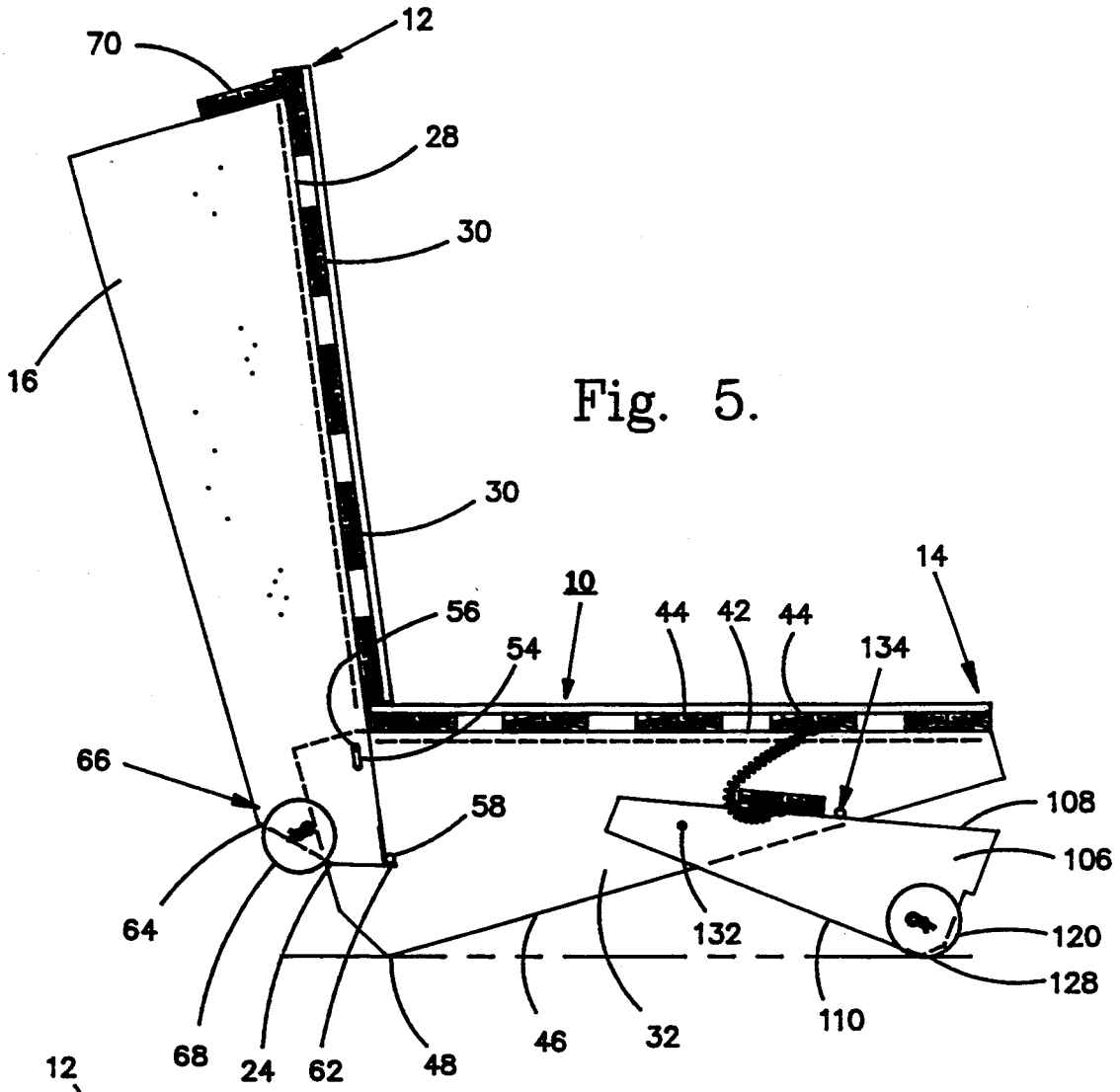

As the seat section 12 is further rotated upwardly, or clockwise as viewed in FIG. 4, it will eventually reach the orientation shown in FIG. 5. At this point, the rear surface 108 of legs 104 and 106 of the swing arm assembly 100 abuts stop members or pins 134 which extend towards each other as they are secured to frame members 32 and 34. Specifically, in this latter orientation, the edge 128 of the bottom edge surface 110 is in engagement with the floor and acts as a weight bearing edge, to alleviate the bearing of any weight on wheels 120 as described below. In this orientation the outer surface of section 12 is disposed approximately 8.5 degrees to the left of vertical, as viewed in FIG. 5, and the stop pin 58 is still in engaged, overlying relationship with the upper section of the stop plate 62. Thus, it should be apparent that the movement of the section 14 into the horizontal position illustrated in FIG. 5 is positively controlled by maintaining the locked connection between sections 12 and 14, as the section 12 is being gripped and rotated in a clockwise direction, as viewed in FIG. 5.

Referring to FIG. 6, after the frame 10 has been moved into the orientation shown in FIG. 5, the section 12 is rotated in a clockwise direction (as viewed in FIG. 6) into a position wherein the upper supporting surfaces provided by the elongate slats 30 and 44 are disposed at approximately 90 degrees to each other, as is shown in FIG. 6. In other words, the outer surface provided by the slats of section 12 is oriented in a generally vertical direction, and, in this orientation, the upper section of the stop plate 62 is moved out of underlying position with the stop pin 58, as shown in FIG. 6. In this latter orientation it is possible to move the section 12 in a generally upward direction, as is illustrated by arrow 75, to thereby move the stop plate 62 into a position above the stop pin 58 (not shown). It should be noted that, in this latter position, the hinge pin 56 is located at the opposite end of the slot 54 from the end it occupies when the upper section of the stop plate 62 is in underlying, locking engagement with the stop pin 58.

After the stop plate 62 has been moved out of underlying relationship with the stop pin 58, and the section 12 lifted to cause the stop plate to clear, or move about the stop pin, the section 12 is then rotated in a counterclockwise direction as viewed in FIG. 6, to thereby pivot the section 12 into an orientation in which the upper surface thereof is disposed in a generally horizontal plane, as is shown in FIG. 7. In fact, the upper surfaces of sections 12 and 14 are located essentially in the same plane to thereby form a bed frame.

As was pointed out earlier herein, in a bi-fold construction the length of the seating piece from one side to the other actually constitutes the length of the bed frame, in the open configuration illustrated in FIG. 7. In other words, when the frame 10 is opened into a bed frame, a person generally sleeps on the frame with his or her head adjacent one side edge and his or her feet adjacent the opposite side edge. The width of the bed, which generally is a full or queen size bed, is the distance between the forward edge of the section 12 and the top edge of the section 14, when the sections are disposed in the orientation illustrated in FIG. 7.

The frame 10 of the present invention, in addition to being held in the couch configuration shown in FIG. 1, and the bed configuration shown in FIG. 7, can be held in a reclining couch configuration shown in FIG. 8.

To move the frame 10 into the reclining couch configuration of FIG. 8, from the couch position of FIG. 1, one must follow the previously described instructions, to first convert the frame from the couch position into the bed configuration, as the hinge and stop mechanism 50 must be disengaged prior to the conversion process. Once the frame 10 is in the bed configuration, one can lift and thereby rotate the frame section 14 away from the floor which will cause the swing arm assembly initially to roll or slide on wheels 120 towards the rear of the frame section 14 as it pivots about pivot point 132, until the swing arm assumes a position similar to that shown in FIG. 4.

A manual force can then be applied to the swing arm assembly to pivot it further inwardly until bottom surface 114 is generally parallel to the floor. The rotation of the frame section 14 towards the frame section 12, continues until the bottom surface 114 of each of legs 104 and 106 rests on the floor. In that position, the floor, the bottom surface 114 and the pivot point 132 forms a triangular arrangement to provide support and retain the frame in the reclining couch position of FIG. 8.

As previously described, since the wheels, if utilized, are secured to legs 104 and 106 so that their circumference is tangential to the lower surface 114 of legs 104 and 106, when lower surface 114 rests on the floor or other surface in the reclining couch orientation, the legs 104 and 106, rather than the wheels 120 themselves, will acts as load bearing members. The position of the lower surface 114 of legs 104 and 106 provides the support to maintain the backrest section 14 in the reclining position.

If the frame is in the reclining couch position shown in FIG. 8, and one wishes to move the frame into the bed position shown in FIG. 7, from the rear, one can easily lift the backrest section 14 upwards, and manually position the swing arm assembly 100 to move away from its stored position so as to act as the previously described load bearing member when the frame is in the bed configuration. Thereafter, the backrest section 14 is placed in the bed configuration as shown in FIG. 7.

One can proceed from the bed configuration, and then back to the couch position of FIG. 1, by reversing the previously described steps, it being understood that to proceed from the reclining couch (FIG. 8) to the couch position (FIG. 1), requires that one place the frame in the intermediate position of the bed orientation of FIG. 7.

Referring to FIG. 1, one or more removable arms 80 can be employed with the frame 10, when the frame 10 is in a seating piece orientation as shown in FIGS. 1 and 3. Since the use of an armrest is optional, it is illustrated in phantom in FIG. 1. Suffice it to state that the armrest can be removably attached to section 12 in a variety of ways. In one preferred embodiment the armrest includes a pair of outer posts 82, each having a generally U-shaped slot at the base thereof for frictionally (and removably) engaging side frame members 86 and 88 of section 12.

The present invention is an improvement over my prior invention, as disclosed in my previously mentioned U.S. patent, since it minimizes the amount of space between the rear of the backrest section 14 of the frame 10 and the wall of a room adjacent which the frame may be placed during use. In addition, the swing arm assembly facilitates the conversion between couch, bed and reclining couch positions and maintains the backrest frame section in a reclining orientation when the frame is so used.

Without further elaboration the foregoing will so fully illustrate my invention that others may, by applying current or future knowledge, adapt the same for use under various conditions of service.

I claim:

1. A furniture frame convertible from a first orientation to at least a second orientation, the frame including:

(a) a first section and a second section pivotally connected together by hinge means for hingedly connecting the first and second sections, the sections being movable relative to each other to permit the frame to be moved between a first orientation wherein the frame is generally in a couch orientation with the first section lying generally adjacent a floor and at least a second orientation wherein the frame is generally in a bed orientation with the first and second sections lying generally adjacent the floor;

(b) locking means for releasably locking the first and second sections together when in the first orientation;

(c) swing arm means independent and separate from said locking means, said swing arm means pivotally secured to the second section about a pivot axis and being movable about said pivot axis between a first, retracted position and a second, extended position, the swing arm means facilitating retaining the frame in at least the second orientation when in the extended position; and (d) spring means for aiding in retaining the swing arm means in the retracted position when the frame is in the first orientation and for biasing the swing arm means rearwardly of the second section as the frame is being converted into the second orientation from the first orientation, said spring means being positioned to provide a first line of action on a first side of the pivot axis when the swing arm means is in a retracted position and a second line of action on a second side of the pivot axis when the swing arm is extended from the retracted position, said swing arm means having a sufficient weight and mass to automatically cause the swing arm means to move rearwardly about said pivot axis from the second section of the frame under its own weight and to automatically move the line of action of the spring means from the first line of action to the second line of action when the second section of the frame is tilted rearwardly as the frame is being converted into the second orientation from the first orientation.

2. The frame of claim 1 wherein the swing arm means comprises at least two leg means, each of the at least two leg means being fixedly secured to a first and second end of a generally horizontal support member, each of the leg means being pivotally secured to a rear frame member of the second section of the frame.

3. The frame of claim 2 wherein the leg means additionally comprises rolling means for permitting the leg means to roll on the floor when the frame is moved between the first and at least the second orientations.

4. The frame of claim 1 wherein the frame is additionally movable to a third orientation wherein the frame is generally in a reclining couch orientation.

5. The furniture frame of claim 1, wherein each of the two sections has transversely spaced apart frame members, each of the transversely spaced apart frame members of the one of the two sections having one end closely adjacent to and overlapping an end of a frame member of the other of the two sections to provide multiple pairs of frame members having overlapping ends, the overlapping ends of at least two pairs of frame members each having locking means.

* * * * *